US007207832B2

(12) United States Patent
Liu et al.

(10) Patent No.: US 7,207,832 B2
(45) Date of Patent: Apr. 24, 2007

(54) CABLE ASSEMBLY WITH IMPROVED ENGAGING MEANS

(75) Inventors: Sufeng Liu, Kunsan (CN); Wei-Ya Cheng, Kunsan (CN); Jian-Tao Lin, Kunsan (CN); Jie Cheng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/168,162

(22) Filed: Jun. 27, 2005

(65) Prior Publication Data

US 2006/0141867 A1 Jun. 29, 2006

(30) Foreign Application Priority Data

Dec. 25, 2004 (CN) ..... 2004 2 0054714

(51) Int. Cl.
*H01R 12/24* (2006.01)

(52) U.S. Cl. ..... 439/499

(58) Field of Classification Search ..... 439/499, 439/468, 473, 466, 497, 579
See application file for complete search history.

(56) References Cited

U.S. PATENT DOCUMENTS

| | | | | |
|---|---|---|---|---|
| 5,100,342 | A * | 3/1992 | Olsson | 439/497 |
| 6,758,694 | B2 | 7/2004 | Liu | |
| 6,790,087 | B2 | 9/2004 | Ho | |
| 6,808,410 | B1 | 10/2004 | Lee | |
| 6,916,197 | B1 * | 7/2005 | Wu | 439/484 |
| 6,971,923 | B1 * | 12/2005 | Wu | 439/694 |
| 2005/0054236 | A1 * | 3/2005 | Shi et al. | 439/483 |

* cited by examiner

*Primary Examiner*—Tulsidas C. Patel
*Assistant Examiner*—Phuongchi Nguyen
(74) *Attorney, Agent, or Firm*—Wei Te Chung

(57) ABSTRACT

A cable assembly (1) includes an insulative housing (10) with a number of terminals (20) received therein, each terminal (20) including a mating end (21) and a mounting end (23) opposite to the mating end (21), a cable (50) including a number of conductor cores (51) terminated to the corresponding mounting ends (23), an anchoring element (40) reliably assembled to the housing (10), and a cover (60). The cover partially encloses the housing, and engages with the anchoring element for increasing the retaining force between the housing and the cover.

16 Claims, 6 Drawing Sheets

CABLE ASSEMBLY WITH IMPROVED ENGAGING MEANS

BACKGROUND OF THE INVENTION

1. Field of the Invention

The present invention generally relates to a cable assembly, and more particularly to a Serial ATA cable assembly with improved engaging means for acquiring a reliable connection between a dielectric housing and a cover.

2. Description of the Prior Art

With the miniaturization of electrical devices, the density of electronic components mounted on a panel of the electrical devices is notably increased. An issue is raised when there is a need to release a cable assembly from a mated complementary connector mounted on the panel of the electrical device that the operator can only pull the cable/cover of the cable assembly to unplug the cable assembly. Obviously, this may cause the wires of the cable divorcing from corresponding terminals of the cable assembly, and thus, inevitably influences the signal transmission between the cable assembly and the mated complementary connector, or may cause the cover loosing from the housing of the cable assembly, and thus, inevitably influences the reliable engaging connection between the housing and the cover. To solve these problems, different kinds of electrical connectors are designed.

U.S. Pat. No. 6,758,694 B2 discloses a cable assembly comprises a dielectric housing with a plurality of contacts received therein, a cable electrically terminated to the contacts, a cover assembled to the housing and the cable. The housing includes a plurality of holes defined in walls thereof. During the process of molding the cover, the melted plastic material of the cover flows through the holes. Thus, a plurality of strengthened projections are formed on the cover. These strengthened projections increase the retaining force between the housing and the cover, thereby making the housing engage with the cover more reliably.

U.S. Pat. No. 6,790,087B2 discloses an electrical connector which comprises a housing receiving a plurality of contacts therein, a contact supporting means assembled to the housing for positioning the contacts reliably, and a protective sleeve enveloped the housing and the contact supporting means. To prevent the protective sleeve from separating from the housing, an interference portion is provided on the housing to interferentially engage with the protective sleeve.

U.S. Pat. No. 6,808,410 B1 discloses a cable connector assembly comprising a housing, a plurality of terminals received in the housing, a cable terminated to the contacts, a cover partially enclosing the housing and the cable, a locking member assembled to the cover, and a pulling member sandwiched between the cover and the locking member. When the cable connector assembly is disengaged from corresponding complementary connector, the user only needs to pull the pulling member.

In this art, a cable assembly with improved engaging means between the housing and the cover is provided.

BRIEF SUMMARY OF THE INVENTION

Accordingly, the main object of the present invention is to provide a cable assembly, which has an improved engaging means between the housing and the cover for acquiring a reliable connection therebetween.

The another object of the present invention is to provide a cable assembly, which has a pulling means for disengaging the cable assembly from a complementary connector conveniently.

In order to implement the objects set forth, a cable assembly in accordance with the present invention comprises an insulative housing for receiving a plurality of terminals therein, each terminal comprising a mating end and a mounting end opposite to the mating end, a cable comprising a plurality of conductor cores terminated to the corresponding mounting ends of the terminals, an anchoring element reliably assembled to the housing, and a cover. The cover partially encloses the housing, and engages with the anchoring element for increasing the retaining force between the housing and the cover.

Other objects, advantages and novel features of the invention will become more apparent from the following detailed description of a preferred embodiment when taken in conjunction with the accompanying drawings.

DETAILED DESCRIPTION OF THE INVENTION

Figure 1:
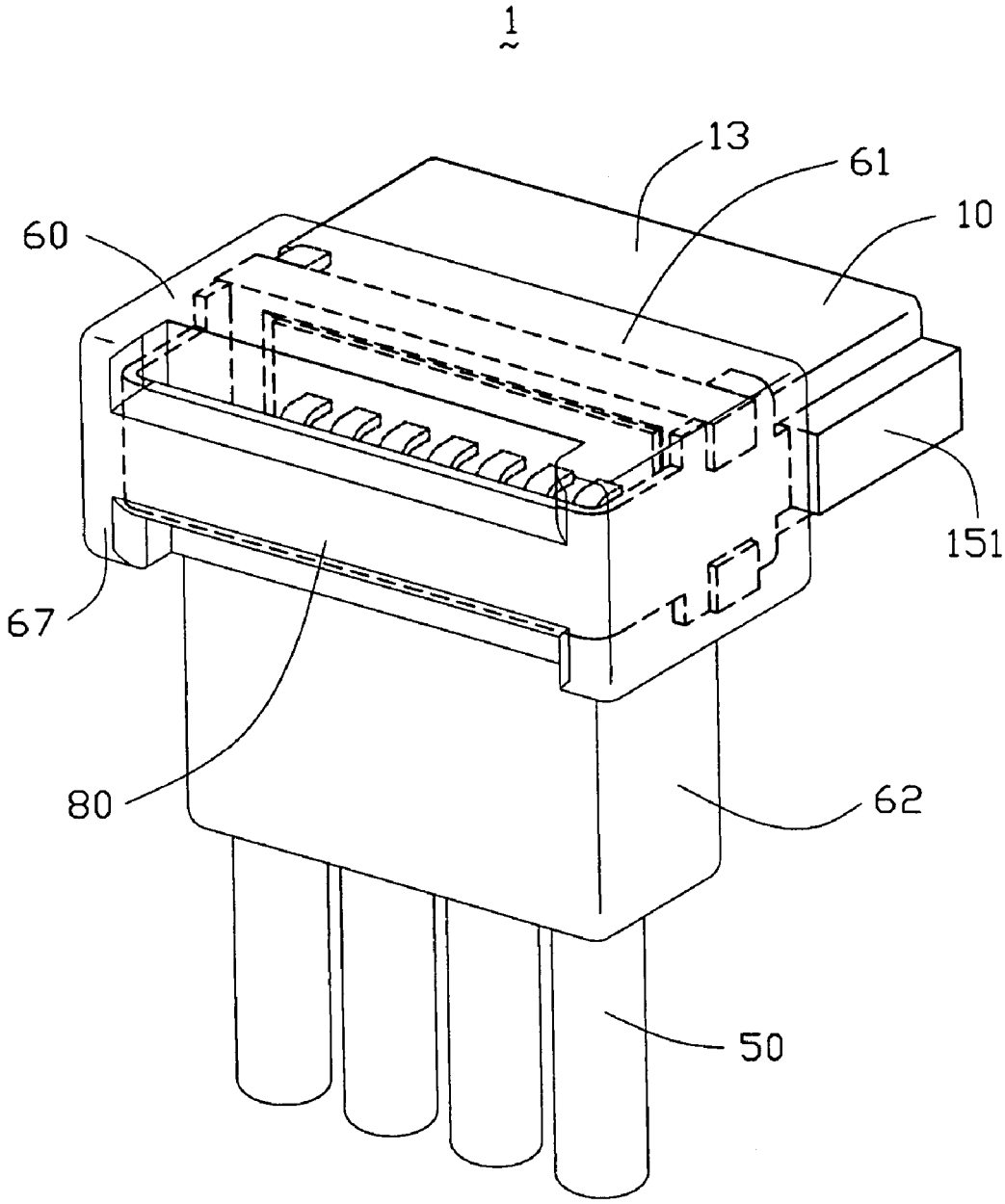
FIG. 1 is an assembled view of a cable assembly in accordance with the present invention, with a cover thereof in a perspective view.
Figure 2:
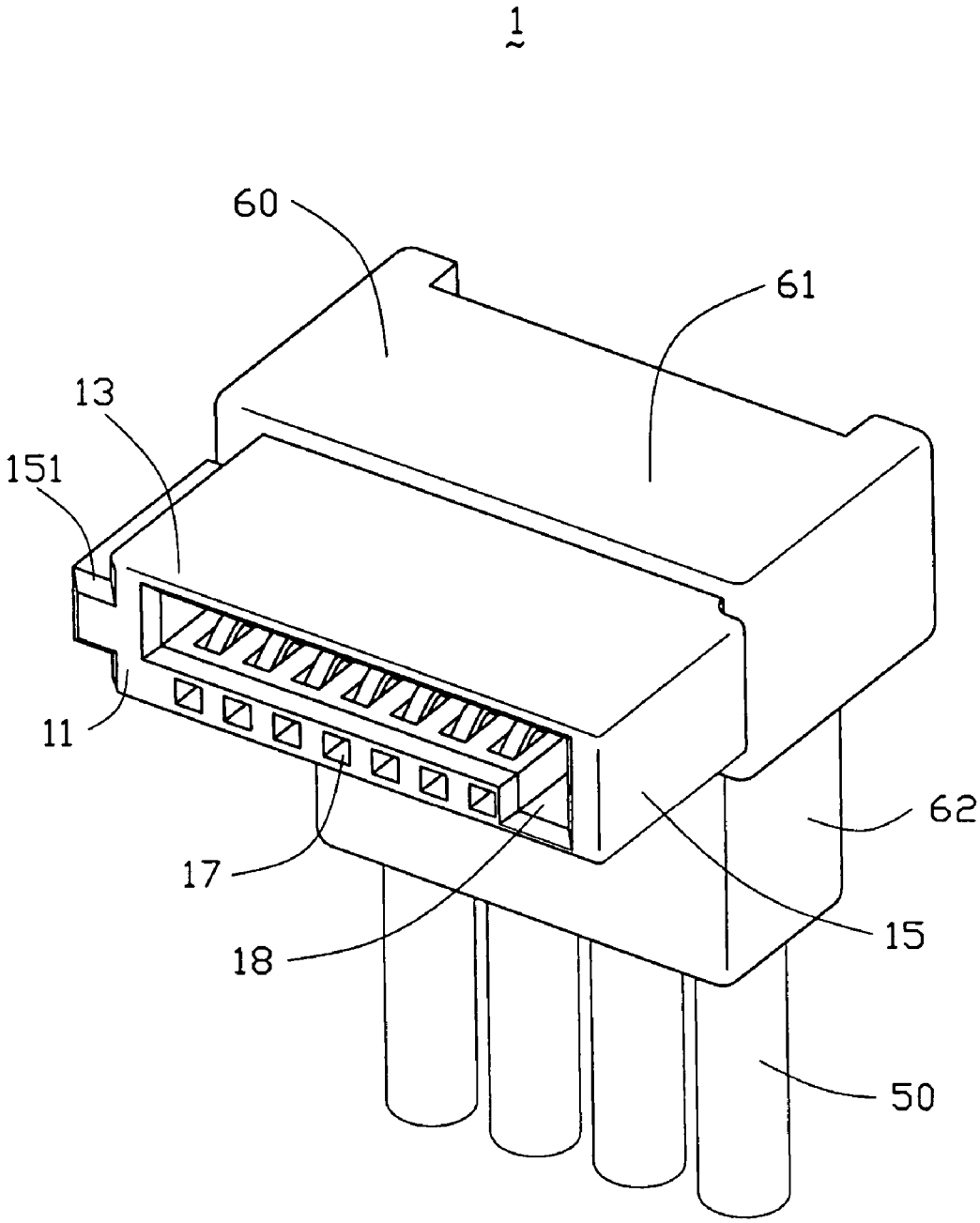
FIG. 2 is a view similar to FIG. 1, but taken from a different aspect.

While the invention may be susceptible to embodiment in different forms, there is shown in the drawings, and herein will be described in detail, a specific embodiment with the understanding that the present discloses is to be considered an exemplification of the principles of the invention, and is not intended to limit the invention to that as illustrated and described herein.

Referring to FIGS. 1–4, a cable assembly 1 in accordance with the present invention comprises an insulative housing 10, a plurality of terminals 20 received in the housing 10, a spacer 30 disposed in the housing 10, a cable 50 electrically terminated with the terminals 20, an anchoring element 40 reliably assembled to housing 10, and a cover 60 partially enclosing the housing 10 and engaging with the anchoring element 40. In a preferred embodiment of the present invention, the cable assembly 1 is in the form of a Serial ATA cable assembly and matable with a complementary electrical connector (not shown here).

The insulative housing 10 is in the shape of a rectangular block and comprises a front end 11, a rear end 12 opposite to the front end 11, an upper wall 13, a lower wall 14, and a pair of opposite sidewalls 15 connected with the upper and lower walls 13, 14. The upper wall 13, the lower wall 14, and the opposite sidewalls 15 together define an L-shaped receiving space 18 for receiving a tongue (not shown) of the complementary electrical connector therein. A plurality of passageways 17 penetrate through the lower wall 14 from the front end 11 to the rear end 12 in a front-to-rear direction. A guiding projection 151 protrudes sidewardly from an outer surface of one sidewall 15 for guiding the cable assembly 1 to engage with the complementary electrical connector properly. A pair of protruding blocks 19 are formed on the upper and lower walls 13, 14, respectively, and positioned adjacent to the rear end 12. Each protruding block 19 comprises a pair of projections 191 sidewardly extending from two edges thereof and exposed beyond the sidewalls 15, respectively. Moreover, the housing 10 further comprises a rectangular opening 121 inwardly hollowed from the rear end 12 and communicated with the passageways 17.

A plurality of electrical terminals 20 are received side by side in corresponding passageways 17. Each terminal 20 comprises a mating end 21, a retaining end 22 rearwardly extending from the mating end 21, and a mounting end 23 downwardly bending from the retaining end 22. Each retaining end 22 defines a plurality of barbs 221 on a pair of sides thereof.

The spacer 30 is a rectangular board, with a size similar to that of the opening 121. The spacer 30 comprises an elongated main body 33, a plurality of through holes 32 penetrating through the main body 33, and a plurality of supporting blocks 31 extending forwardly from a surface of the main body 33. Each supporting block 31 is positioned under corresponding through hole 32 for supporting the retaining end 22 of the terminals 20.

The cable 50 comprises a plurality of wires 52. Each wire 52 comprises a plurality of conductor cores 51.

Figure 3:
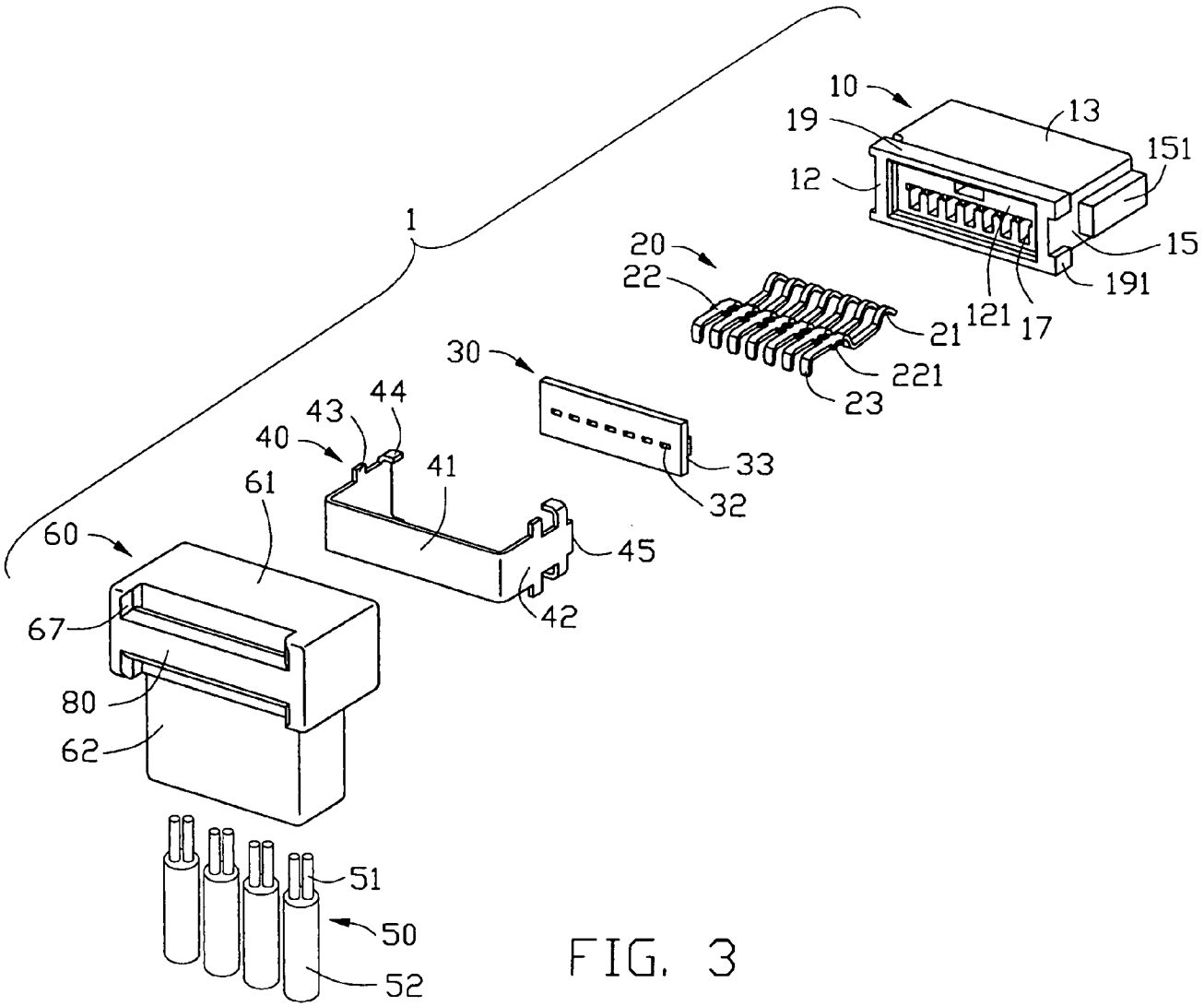
FIG. 3 is an exploded view of the cable assembly shown in FIG. 1.
Figure 4:
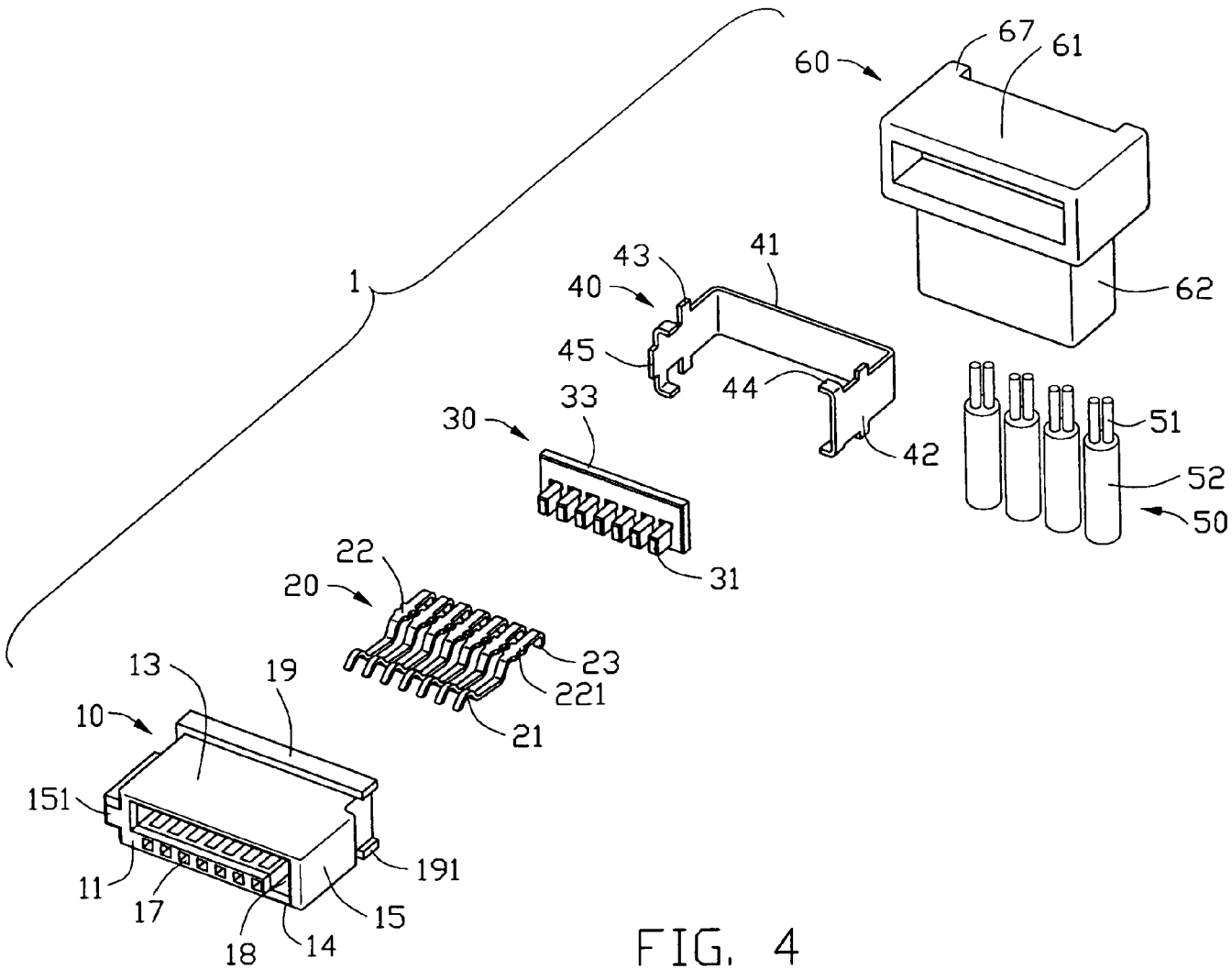
FIG. 4 is a view similar to FIG. 3, but taken from a different aspect.
Figure 5:
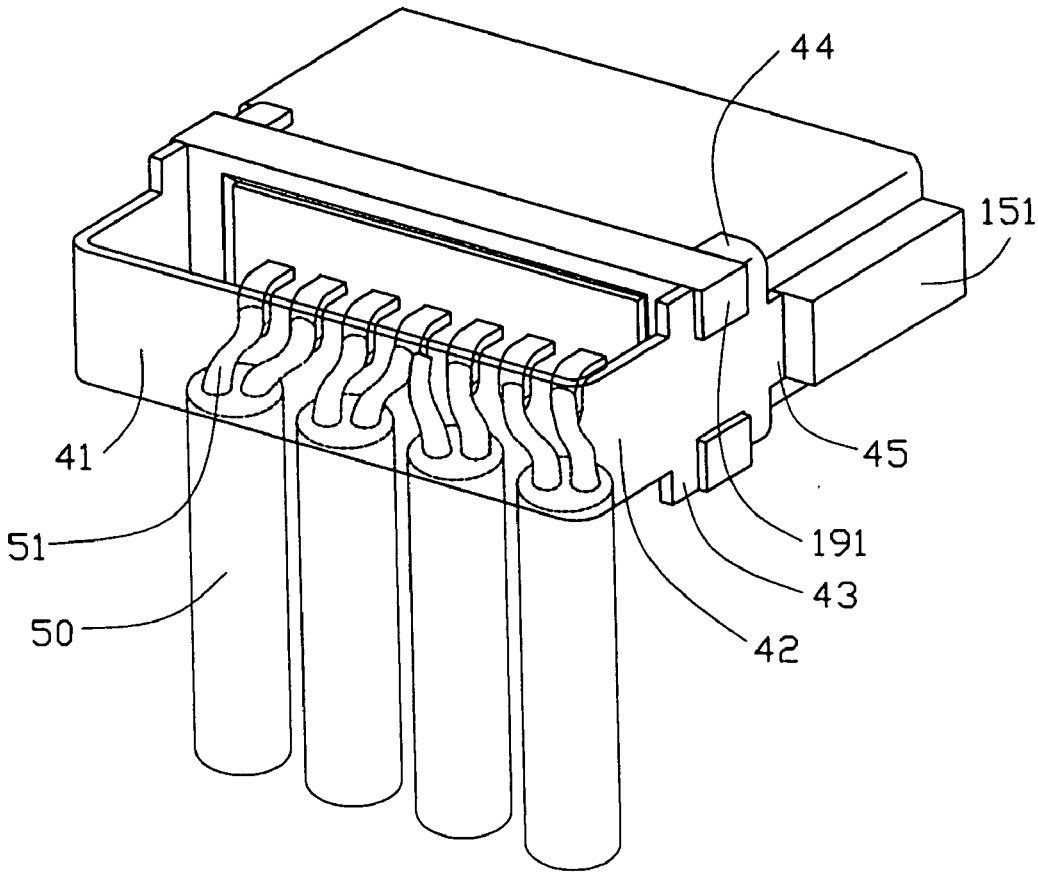
FIG. 5 is a partially assembled view of FIG. 4, with the cable assembled to terminals in a perspective view.

Referring to FIGS. 3 to 4, the anchoring element 40 is of an U-shaped configuration and comprises a main portion 41 and a pair of locking arms 42 extending forwardly from opposite ends of the main portion 41. Each locking arm 42 comprises a pair of claws 44 projecting inwardly from opposite edges of the free end thereof, and a pair of stopping blocks 43 extending sidewardly from opposite edges of the midst thereof, respectively. The locking arm 42 disposed opposite to the guiding projection 151 further comprises a rib 45 extending forwardly from the free end thereof. In the preferred embodiment, the anchoring element 40 is made of metallic material.

The cover 60 with a T-shaped configuration comprises a base 61 and an extending portion 62 downwardly extending from the base 61. The base 61 comprises a pair of extending ribs 67 rearwardly extending from opposite sides thereof.

Referring to FIG. 3, the cable assembly 1 further comprises a pulling means 80 reliably engaging with the cover 60 for operator unplugging the cable assembly 1 from the complementary electrical connector more conveniently. In the preferred embodiment, the pulling means 80 is integrally molded with the cover 60.

In assembly, referring to FIGS. 1 to 5, the terminals 20 are first inserted into the housing 10 in a rear-to-front direction. The mating end 21 of each terminal 20 is received into corresponding passageways 17, and is partly exposed in the receiving space 18 for electrically connected with corresponding terminals of the complementary electrical connector. The retaining end 22 of each terminal 20 are received into corresponding passageways 17 with the barbs 221 interferentially engaging with the inner opposite surfaces of the passageways 17 for securing the terminals 20 in the housing 10 fixedly. The mounting end 23 of each terminal 20 is exposed beyond the rear end 12 of the housing 10 for being soldered with the cable 50. Then, the spacer 30 is pushed and received in the opening 121 of the housing 12 with the supporting blocks 31 received in the corresponding passageways 17 for efficiently preventing the melted plastic material of the cover 60 from flowing into the housing 10 and influencing the electrical connection between the cable assembly 1 and the complementary electrical connector. The mounting ends 23 protrude through the holes 32 of the spacer 30 and bend downwardly, respectively. The conductor cores 52 of the cable 50 are then respectively soldered with the mounting end 23 to form an electrical connection between the cable 50 and the terminals 20.

The anchoring element 40 is then assembled to the housing 10. Two pairs of claws 44 of the anchoring element 40 respectively clasp the upper and lower walls 13, 14 with the projections 191 of housing 10 located between the stopping blocks 43 and the claws 44 and the rib 45 abutting against the distal end of the guiding projection 151. Thus, the anchoring element 40 is fastened with the housing 10 reliably, and cannot occur the deviation in a rear-to-front direction, even in a vibration circumstance.

Referring to the FIGS. 1 to 5, a cover 60 is provided after the housing 10, the terminals 20, the cable 50 and to anchoring element 40 are assembled together. The cover 60 is fanned by an injection molding method in which the injected material is molded over the housing 10, the conjunction of the cable 50 and the terminals 20, and the anchoring element 40. After cooling the injected material, a rear portion (not labeled) of the housing 10 is received in the cover 60. To prevent the cover 60 from separating from the housing 10, after cooling down the cover 60, an interference is provided between the housing 10 and cover 60. In this embodiment, the interference may include either the anchoring element 40 assembled to the housing 10 or the protruding block 19 protruding from the housing 10. These configuration variations can provide interference engagement with the formed cover 60 so as to prevent the cover 60 from loosing from the housing 10 and produce a reliable engaging connection between the housing 10 and the cover 60. Obviously, in this preferred embodiment, the cover 60 is not limited to design only by overmolding but, rather, that those skills can fasten the cover 60, the anchoring element 40 and the housing 10 reliably. In addition, the pulling means 80 is provided and unitarily molded with the cover 60. Between the pulling means 80 and the cover 60, there is a space (not labeled) for a user plugging/unplugging the cable assembly 1 conveniently. In addition, an outer surface of the main portion 41 abuts against an inner surface of the pulling means 80.

Figure 6:
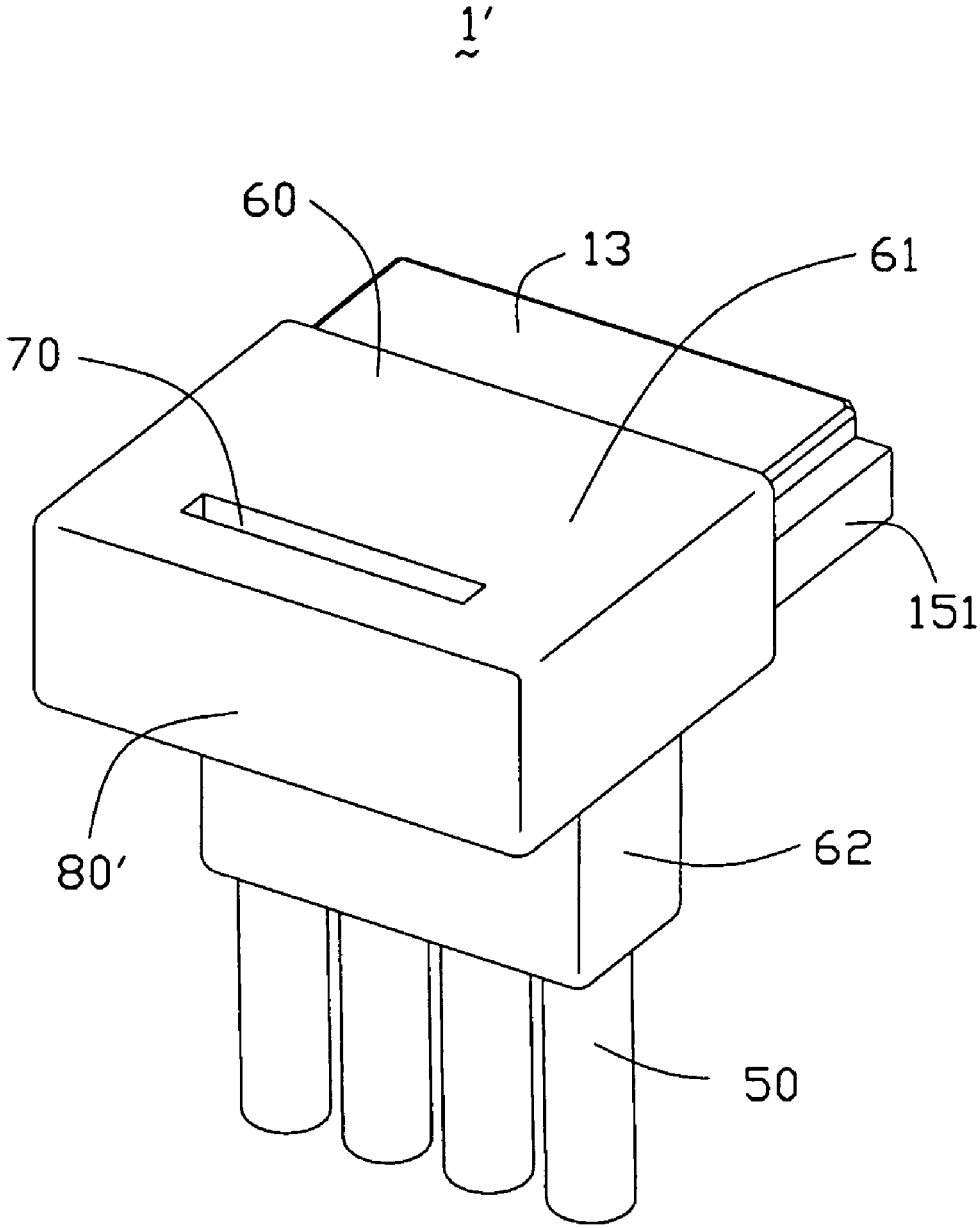
FIG. 6 is an assembled view of the cable assembly in accordance with the second embodiment of the present invention.

Referring to FIG. 6 in conjunction with FIGS. 3 to 4, the cable assembly 1' of a second preferred embodiment in accordance with the present invention is similar to the cable assembly 1 in structure. However, in the second preferred embodiment, the cover 60 is integrally molded with the pulling means 80' and has the same thickness as the pulling means 80'. In addition, between the cover 60 and the pulling means 80', there are a space 70, functioned as operation area, for allowing operator unplugging the cable assembly 1' from the complementary electrical connector conveniently. In addition, the main portion 41 of the anchoring element 40 is molded within the pulling means 80'. When a force is applied on the pulling means to unplug/plug the cable assembly 1', first, the instant invention can increase intensity of the cable assembly 1' due to the design that the anchoring element 40 is engaged with the housing 10, and molded within the cover 60, second, the instant invention can be easy to unplug from a mating connector due to a reason that the force is applied on both the pulling means 80' and the anchoring element 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

an insulative housing;

a plurality of terminals received in the insulative housing, each terminal comprising a mating end and a mounting end opposite to the mating end;

a cable comprising a plurality of conductor cores terminated to corresponding mounting ends of the terminals;

an anchoring element assembled to the housing; and a cover molded with the housing and engaging with the anchoring element with a rear portion of the housing being received in the cover; wherein the anchoring element comprises a main portion and a pair of locking arms extending forwardly from the main portion, and wherein the locking arms lock with the housing; wherein each locking arm comprises a claw projecting inwardly from edge of the locking arm thereof, and wherein the claw clasp the housing reliably for acquiring enough retaining force.

2. The cable assembly as claimed in claim 1, wherein the anchoring element defining a U-shaped cross-sectional configuration including a main portion close to a space defined by the cover and a pair of locking arms engaged with the housing, and the cable extends essentially perpendicular to said cross-sectional configuration.

3. The cable assembly as claimed in 1, wherein the cable assembly further comprises a pulling means integrally molded with the cover and abutting against the anchoring element.

4. The cable assembly as claimed in claim 3, wherein the pulling means comprises a main portion, the main portion abuts against the anchoring element.

5. The cable assembly as claimed in claim 1, further comprising a pulling means molded with the cover, wherein further comprising a space between the pulling means and the cover for allowing a user to plug/unplug the cable assembly conveniently.

6. The cable assembly as claimed in claim 5, wherein a part of the anchoring element is molded within the pulling means for ensuring intensity of the cable assembly.

7. The cable assembly as claimed in claim 1, wherein the housing further comprises an upper wall, a lower wall opposite to the upper wall, a pair of sidewalls connected with the upper and lower walls, which together defines a L-shaped receiving space for receiving the complementary connector therein.

8. The cable assembly as claimed in claim 7, wherein the housing further comprises a pair of protruding blocks formed on the upper and lower walls of the housing respectively, and wherein each protruding block interferes with the cover for increasing the retaining force therebetween.

9. The cable assembly as claimed in claim 8, wherein each locking arm further comprises a stopping block extending sidewardly from edge of the midst thereof, respectively, and wherein the protruding block comprises a projection sidewardly extending from the edge thereof and exposed beyond the sidewall, the projection is located between the stopping block and the claw.

10. The cable assembly as claimed in claim 9, wherein the cable assembly further comprises a guiding projection sidewardly extending from a sidewall of the housing for guiding the cable assembly to engage with complementary connector properly.

11. The cable assembly as claimed in claim 10, wherein the anchoring element further comprises a rib extending forwardly from one locking arm and abutting against distal end of the guiding projection. element.

12. A cable assembly, comprising:

an insulative housing;

a plurality of terminals received in the insulative housing, each terminal comprising a mating end and a mounting end opposite to the mating end;

a cable comprising a plurality of conductor cores terminated to corresponding mounting ends of the terminals;

a cover sub-assembly partially enclosing the housing, and defining a space around a rear portion thereof for a user to unplug the cable assembly conveniently.

13. The cable assembly as claimed in claim 12, wherein said cover sub-assembly including an over-molded insulator associated with a metallic anchoring element, said anchoring element efficiently engaged with the housing for absorbing forces due to plugging/unplugging thus preventing the cable from being damaged.

14. The cable assembly as claimed in claim 13, wherein said anchoring element includes a portion exposed to the space rather than being embedded within the insulator.

15. The cable assembly as claimed in claim 12, wherein the anchoring element defining a U-shaped cross-sectional configuration including a main portion close to the space and a pair of locking arms engaged with the housing, and the cable extends essentially perpendicular to said cross-sectional configuration.

16. The cable assembly as claimed in claim 15, wherein the cable is essentially located between the main portion and front ends of the locking arms in a front-to-back direction) and between the two locking arms in a transverse direction perpendicular to said front-to-back direction.

* * * * *